United States Patent [19]

Bergman

[11] Patent Number: 4,458,619

[45] Date of Patent: Jul. 10, 1984

[54] APPARATUS FOR REDUCING ROLL AND PITCH MOTIONS OF FLOATING VESSELS

[75] Inventor: Gunnar B. Bergman, Montecito, Calif.

[73] Assignee: Seatek Corporation, Goleta, Calif.

[21] Appl. No.: 466,369

[22] Filed: Feb. 15, 1983

Related U.S. Application Data

[60] Division of Ser. No. 243,354, Mar. 13, 1981, Pat. No. 4,411,212, which is a continuation of Ser. No. 045,615, Jun. 5, 1979, abandoned, which is a continuation-in-part of Ser. No. 920,469, Jun. 29, 1978, abandoned.

[51] Int. Cl.[3] ..... B63B 39/03; B63B 39/06

[52] U.S. Cl. ..... 114/125; 114/126

[58] Field of Search ..... 114/122, 125, 126, 67 A, 114/56

[56] References Cited

U.S. PATENT DOCUMENTS

| | | | |
|---|---|---|---|
| 2,988,035 | 6/1961 | Gram | 114/67 A |
| 3,097,622 | 7/1963 | Bell | 114/125 |
| 3,141,436 | 7/1964 | Cathers et al. | 114/67 A |
| 3,376,840 | 4/1968 | Zaphiriou et al. | 114/56 X |
| 3,788,263 | 1/1974 | McDermott et al. | 114/125 |
| 3,797,440 | 3/1974 | Pangalila | 114/125 |
| 3,896,755 | 7/1975 | Marbury | 114/126 |

FOREIGN PATENT DOCUMENTS

| | | | |
|---|---|---|---|
| 653180 | 5/1936 | Fed. Rep. of Germany | 114/125 |

*Primary Examiner*—Sherman D. Basinger

[57] ABSTRACT

Apparatus for substantially reducing the roll and pitch motions of a floating vessel in commonly occurring seas is described. The apparatus comprises a recessed cavity formed in a substantial area of the bottom of the hull of the vessel and has an airblower coupled to the cavity for introducing air into it. The apparatus may include horizontal planes for restoring the effect of the added mass of the water on the stability of the vessel.

6 Claims, 12 Drawing Figures

APPARATUS FOR REDUCING ROLL AND PITCH MOTIONS OF FLOATING VESSELS

CROSS-REFERENCE TO RELATED APPLICATION

This is a division of Ser. No. 243,354 filed Mar. 13, 1981, now U.S. Pat. No. 4,441,212, which is a continuation of Ser. No. 045,615 filed June 5, 1979 and now abandoned, and which is a continuation-in-part of Ser. No. 920,469 filed June 29, 1978 and now abandoned.

BACKGROUND OF THE INVENTION

Ships and other floating platforms often roll and pitch so severely when on station at sea, for example, in oil drilling and pipe-laying operations, that operations must be discontinued. Many prior systems for reducing the roll and pitch motions of vessels have attempted in various ways to damp these motions. One prior system proposes a series of interconnected tanks and airblower to lengthen the natural periods of these motions by reducing the righting moment of the vessel. See, for example, U.S. patent application Ser. No. 787,756, entitled, "System for Stabilizing a Floating Vessel" filed on Apr. 15, 1977, by Gunnar B. Bergman now U.S. Pat. No. 4,140,074. However, apparatus for controlled reduction of righting moment and correspondingly lengthened roll and pitch periods of a vessel constructed according to the present invention, is less costly than prior art systems. Furthermore, the present invention requires less space on deck and within the hull of the vessel on which it is installed, thus leaving more space available for equipment and other cargo related to the drilling or other operations of the vessel.

SUMMARY OF THE INVENTION

A vessel constructed in accordance with principles of the present invention radically changes the roll and pitch motion characteristics of the vessel to substantially reduce offensive roll and pitch motions while the vessel is on station or underway.

The hull of such a vessel includes a recessed cavity formed in the bottom thereof coupled to an airblower pump for forcing air into the cavity when reduction of roll and pitch motions is desired. In a calm sea, the cavity is completely filled with sea water. However, when air is forced into the cavity, the righting movement for both roll and pitch axes are reduced. Both the roll period and pitch period of the vessel are lengthened, and the roll and pitch response of the vessel is correspondingly reduced. If the cavity is large enough, either roll or pitch or both motions can be dramatically reduced.

When cavities are added to the hull of a vessel as shown variously in FIGS. 1B, 2B, and 3, the added mass of water which contributes to the apparent stability of the vessel is reduced when compared with vessels without such cavities. Therefore, a vessel constructed according to another embodiment of the present invention includes horizontal planes, installed generally parallel to the deck of the vessel and attached along each side of the cavity. Further improvement in system performance is obtained by extending the planes outboard of the hull. These planes effectively restore the influence of the added mass of the water on the apparent stability of a vessel having cavities formed in its hull.

The horizontal planes may be included with any shape recessed cavity, whether the shape is circular, polygonal, or annular. Thus, addition of the planes enhances performance of all configurations of the present invention.

DESCRIPTION OF THE PRREFERRED EMBODIMENT

Figure 1A:
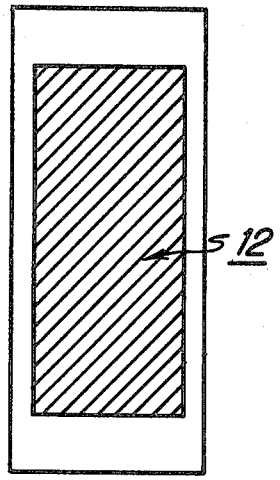
FIG. 1A is a bottom view of the hull of a vessel constructed according to the preferred embodiment of the present invention incorporating a recessed cavity over a substantial portion of its area.
Figure 1B:
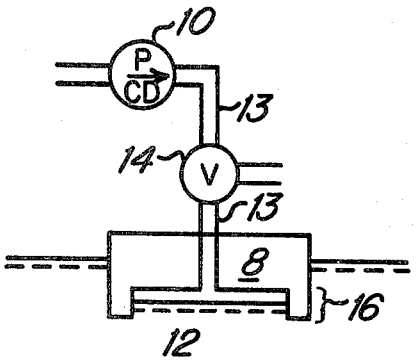
FIG. 1B is a cross-sectional view of the hull of FIG. 1A.

The configuration of FIGS. 1A and 1B is suitable for reducing the rolling motion of barge hull 8 and is also effective for reducing the pitching motion to a lesser extent. The configuration of FIGS. 2A and 2B suppresses rolling and pitching motion equally for the case of a circular platform. FIGS. 1A and 1B and 2A and 2B represent two topologically distinct cases from which many other geometries, such as square and triangular, may be derived.

When the system is active, pump 10, schematically shown coupled to cavity 12 via conduit 13, inflates the cavity until it is approximately half-full of air as shown. Thereafter, pump 10 operates only as necessary to replace air that may escape from cavity 12 when the seas are heavy. Air may be removed from cavity 12 by operating valve 14 located in the inflation line just below pump 10 but above the outside water line.

Cavity 12 symmetrically disposed in hull 8 is so dimensioned that when it is one-half inflated with air, the vessel still has a positive righting moment in roll and pitch. However, to preclude instability and the associated danger of capsizing, it is desirable to make vertical height 16 of cavity 12 relatively small. If cavity 12 is so dimensioned, the water surface within the cavity may touch portions of its top for small angles of roll and pitch inclination, for example, in the range of 3° to 6°. When the water surfaces touches the top of the cavity, the cavity is said to saturate. As water gradually contacts more and more of cavity top 20 and the cavity becomes saturated, the effect of the cavity on reducing the righting moment of the vessel becomes less and less. Ultimately, as the roll or pitch angle is increased beyond an angle in this range, the righting moment increases at a much higher rate, approaching that of the natural righting movement of the vessel. Thus, for example, a vessel having a cavity which saturates at inclination angles of 6° will respond nearly according to its natural characteristics at inclination angles much greater than six degrees and will be much less likely to capsize in heavy seas and strong winds.

Figure 3:
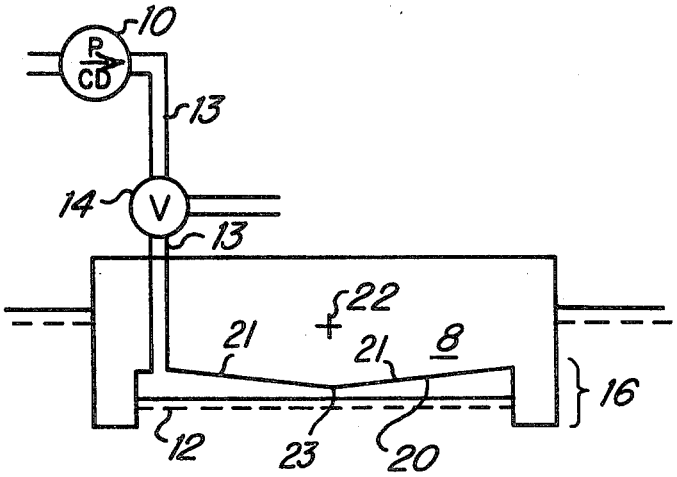
FIG. 3 is a cross-sectional view of the hull of FIG. 1A in which the recessed cavity includes a dihedral roof.

The resistance of a vessel incorporating the present invention to capsizing is further enhanced if top 20 of the recessed cavity is not flat as shown in FIG. 1B but dihedral as shown in FIG. 3. Saturation of a cavity having a dihedral top is not gradual, since water touches substantially the entire depressed half of the cavity top at once. Hence, as soon as saturation occurs, the righting moment will increase at about the same rate as that of the natural righting moment of the vessel.

Figure 4:
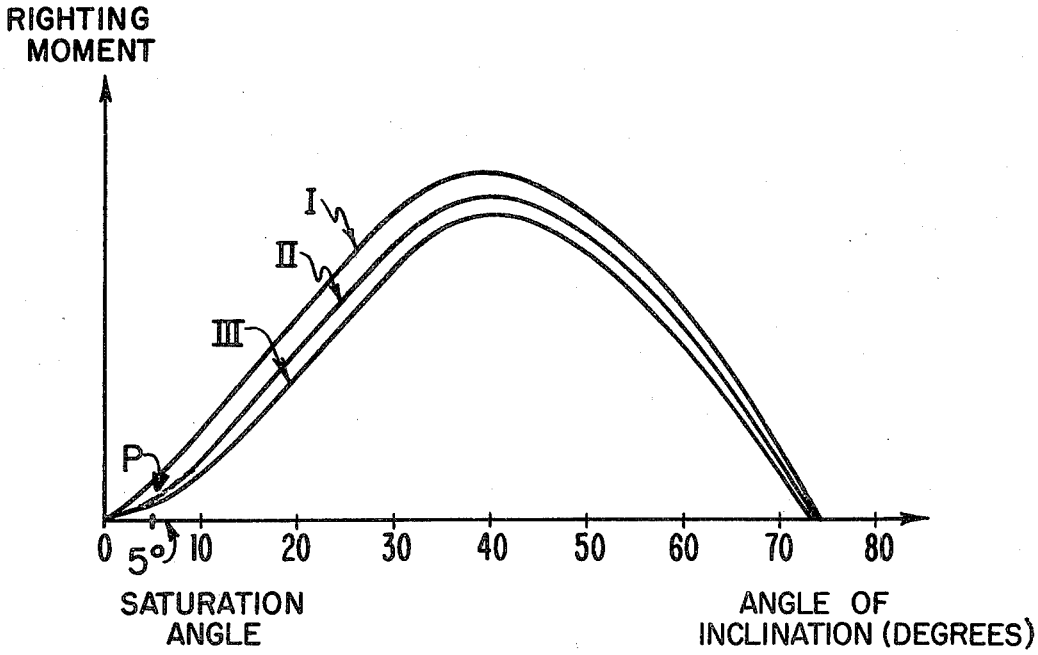
FIG. 4 is a graph for comparing the righting movement versus angle of inclination characteristics of the hulls of FIGS. 1B and 3 with an unmodified hull.

FIG. 4 illustrates how cavities having different top configurations influence the righting moment curve of a vessel. Curve I is a typical righting moment characteristic for a vessel having an unmodified hull. Curve III is a typical righting moment characteristic for a vessel having a hull modified according to the configuration of FIGS. 1A and 1B, where saturation is assumed to begin at 5° and is marked P. Curve II, the characteristic of the hull configuration of FIG. 3, shows a sharp discontinuity in the rate of change at P, indicating relatively sudden restoration of nearly natural righting moment characteristics of the vessel. It should be noted that curves II and III are substantially superimposed from 0° to 5°, and, above 5° the righting moment of a hull designed according to FIG. 3 is greater than that of a hull designed according to FIG. 1B.

The dihedral angle is determined first by the tank height, the lowest point of the dihedral to P extending to approximately one-half the tank height. Other factors for determining dihedral angle include safety considerations and operational limitations of the vessel. Thus, for the example illustrated in FIG. 4, the dihedral angle is about 5°.

The description above and FIG. 4 assumes symmetry of dihedral cavity top and vessel inclination angle about longitudinal axis 22 of the hull shown in FIG. 3. For illustrative purposes, axis 22 can be either a pitch or a roll axis of the vessel. Referring again to FIG. 3, cavity top 20 comprises planes 21 intersecting at apex 23. As used herein, the axis of the dihedral formed in the top of cavity 12 corresponds to the intersection of planes 21 at apex 23. Note that the axis of the dihedral is parallel to longitudinal axis 22 of the hull. The dihedral feature of the present invention is effective for reducing vessel motion about the axis of the vessel which is parallel to a dihedral axis.

As described earlier in this specification, cavities constructed according to the present invention are effective for reducing vessel motion about more than one axis of the vessel, typically the roll and pitch axes. Thus, cavities constructed according to the present invention can include dihedrals having more than one axis, typically transverse to each other, for example, one parallel to the roll axis and the other parallel to the pitch axis of the vessel.

Since the present invention is useful for controlling both roll and pitch motions of a vessel, it is also useful for controlling vessel motion about all other axes intermediate the roll and pitch axes. For example, the top of the cavity could be polyhedral, having many dihedral axes parallel to different transverse axes of the hull where tranverse refers to both port-to-starboard and bow-to-stern (longitudinal) axes. A cavity top formed as an inverted cone is a special case of the polyhedral configuration.

The dihedral of a cavity top according to the present invention can be asymmetric to provide for unsymmetrical hull and cavity configurations and their respective roll and pitch responses. Furthermore, referring to FIG. 3, top 20 of cavity 12 need not be symmetrical as viewed from the bottom of hull 8.

Top 20 of cavity 12 is typically, but, not necessarily, below the ambient water line outside the hull. This configuration adds a second safety factor in that all air from cavity 12 may be completely removed simply by opening valve 14, as described above. When cavity 12 is entirely full of water, the righting moment of the vessel is restored to that of an unmodified hull as shown by curve I of FIG. 4.

Figure 2A:
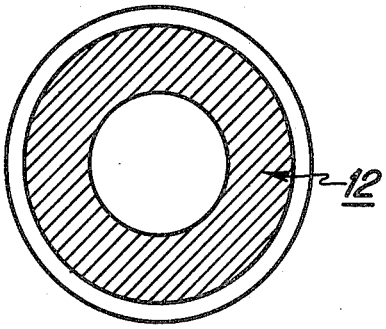
FIG. 2A is a bottom view of the hull of a vessel constructed according to another embodiment of the present invention incorporating a recessed cavity over a substantial portion of its area.
Figure 2B:
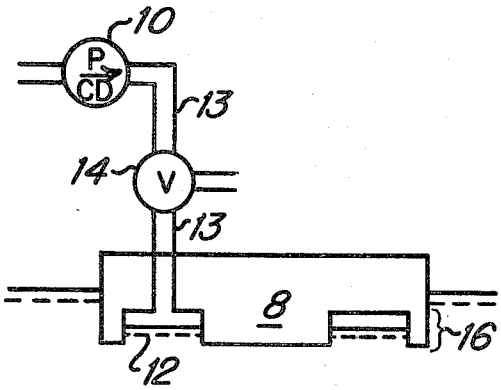
FIG. 2B is a cross-sectional view of the hull of FIG. 2A.
Figure 5A:
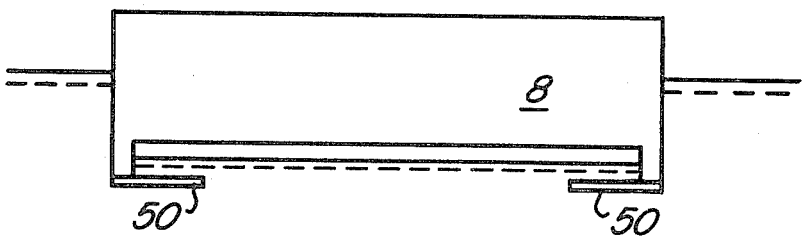
FIG. 5A is a cross-sectional view of the hull of FIG. 1B incorporating horizontal planes according to another embodiment of the present invention.
Figure 6A:
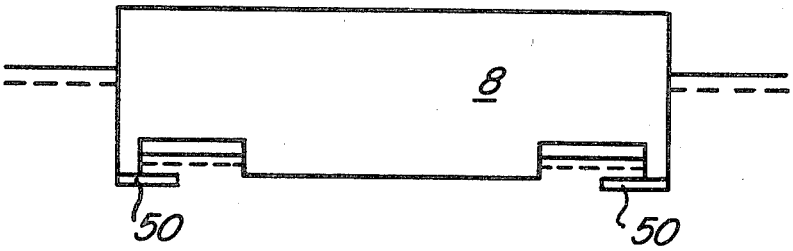
FIG. 6A is a cross-sectional view of the hull of FIG. 2B incorporating inboard-extended horizontal planes according to another embodiment of the present invention.
Figure 7A:
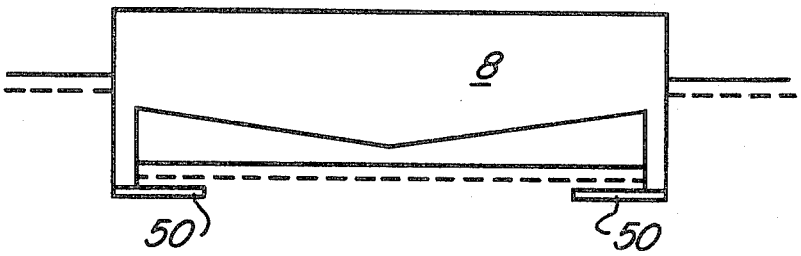
FIG. 7A is a cross-sectional view of the hull of FIG. 3 incorporating horizontal planes according to another embodiment of the present invention.

Referring now to FIGS. 5A and 6A, horizontal planes 50 have been rigidly connected to the hull configurations of FIGS. 1B and 2B, respectively. As much as fifty percent (50%) bottom area of each cavity is covered by the planes. As water moves in and out of the cavity, planes 50 effectively restore the added mass of the water on the apparent stability of the vessel by counteracting the small losses in the moments of inertia which may be observed in other configurations of the invention. Planes 50 are effective for improving performance in both roll and pitch axes.

Figure 5B:
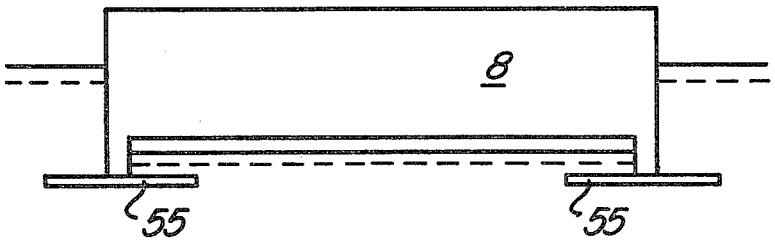
FIG. 5B is a cross-sectional view of the hull of FIG. 1B incorporating outboard-extended horizontal planes according to another embodiment of the present invention.
Figure 6B:
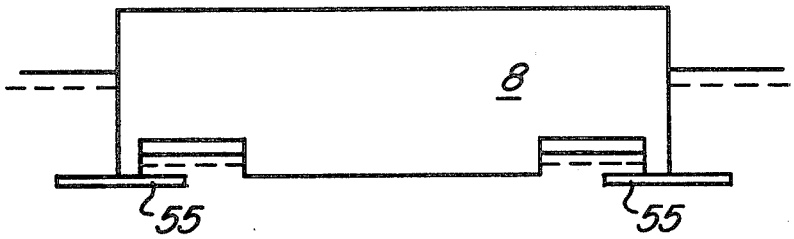
FIG. 6B is a cross-sectional view of the hull of FIG. 2B incorporating outboard-extended horizontal planes according to another embodiment of the present invention.
Figure 7B:
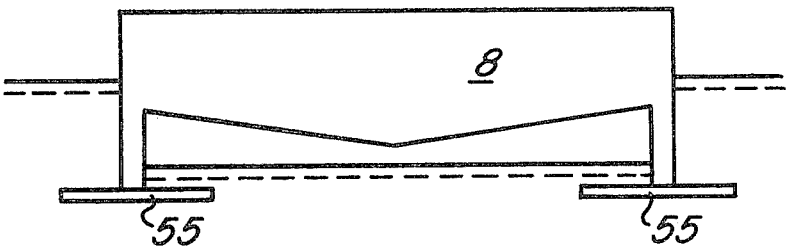
FIG. 7B is a cross-sectional view of the hull of FIG. 3 incorporating outboard-extended horizontal planes according to another embodiment of the present invention.

Further improvement is obtainable by extending the planes outboard of the hull as shown in FIGS. 5B, 6B, and 7B. The area of the outboard-extended planes can be as large as approximately equal to the area covering the bottom of the cavity.

As indicated elsewhere in this specification, the recessed cavity may be circular or polygonal or annular in shape. The airblower and conduit necessary for inflating the cavity are not shown in FIGS. 5A through 7B.

I claim:

1. Apparatus for reducing roll and pitch motion of a floating vessel having first and second modes of operation, said apparatus comprising:

a continuous recessed cavity formed and symmetrically disposed in a substantial portion of the bottom of the hull of the vessel, said cavity having a bottom portion completely open to the water and having a top, corresponding to the bottom of the hull of the vessel, formed to control the rate of change of the righting moment of the vessel;

conduit means coupled to the top of said cavity for providing air passageways thereto; and means coupled to said conduit means for selectively providing air to the cavity to control the water level therein to substantially reduce the natural roll and pitch righting moments of the vessel in the first mode of operation, and to substantially restore the natural roll and pitch righting moments of the vessel in the second mode of operation, said first and second modes of operation being determined by the water level in the cavity during roll and pitch motion of said vessel in the water in which said vessel is floating;

said water level in said cavity being selected to control the rate of change of the righting moment of the vessel by substantially reducing the natural roll and pitch righting moments thereof in the first mode of operation, and by substantially restoring the natural roll and pitch righting moments thereof in the second mode of operation;

said top of the cavity including an unrecessed portion which remains in contact with the water in both the first and second modes of operation, said cavity substantially surrounding said unrecessed portion

2. Apparatus in claim 1 further including added-mass enhancing means disposed along the sides of the bottom of the cavity and attached to the side walls of said cavity for modifying the movement of water into and out of the cavity.

3. Apparatus as in claim 2 wherein the added-mass enhancing means comprise horizontal planes rigidly connected to the sides of the cavity for reducing the bottom portion of the cavity open to water.

4. Apparatus as in claim 3 wherein the planes are substantially parallel to the deck of the vessel.

5. Apparatus as in claim 3 or 4 wherein the planes extend outboard of the hull of the vessel.

6. Apparatus as in claim 1 wherein the hull of the vessel is circular having an annular recessed cavity formed therein, said annular cavity surrounding said unrecessed portion of the hull which remains in contact with the water in both the first and second modes of operation.

* * * * *